US009562648B2

(12) United States Patent
Kristola et al.

(10) Patent No.: US 9,562,648 B2
(45) **Date of Patent: *Feb. 7, 2017**

(54) CHEMICAL INJECTION SYSTEM

(71) Applicant: Linc Energy Systems, Inc., Wheat Ridge, CO (US)

(72) Inventors: Jay L. Kristola, Mayville, WI (US); Michael D. Farrell, Brookfield, WI (US); David J. Nowak, Milwaukee, WI (US)

(73) Assignee: Linc Energy Systems, Inc., Wheat Ridge, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/040,095

(22) Filed: Feb. 10, 2016

(65) Prior Publication Data

US 2016/0161059 A1 Jun. 9, 2016

Related U.S. Application Data

(63) Continuation of application No. 13/598,208, filed on Aug. 29, 2012, now Pat. No. 9,261,087.

(51) Int. Cl.

| | |
|---|---|
| ***F04B 43/067*** | (2006.01) |
| ***F04B 43/107*** | (2006.01) |
| ***F04B 43/02*** | (2006.01) |
| ***F17C 7/02*** | (2006.01) |
| ***F04B 9/04*** | (2006.01) |

(Continued)

(52) U.S. Cl.

CPC ..... *F17C 7/02* (2013.01); *F04B 9/042* (2013.01); *F04B 13/00* (2013.01); *F04B 23/06* (2013.01); *F04B 43/067* (2013.01); *F04B 43/107* (2013.01); *F04B 43/026* (2013.01); *F04B 2205/09* (2013.01); *F17C 2250/03* (2013.01); *F17C 2265/027* (2013.01); *F17C 2270/01* (2013.01); *Y10T 137/0318* (2015.04); *Y10T 137/86131* (2015.04)

(58) Field of Classification Search

CPC ..... F04B 43/067; F04B 43/107; F04B 43/026; F04B 2205/09

USPC ..... 417/20, 43, 379, 383, 388, 389

See application file for complete search history.

(56) References Cited

U.S. PATENT DOCUMENTS 1,301,485 A * 4/1919 Muller ..... F04B 43/067 417/388

2,856,857 A 10/1958 Saalfrank (Continued)

*Primary Examiner* — Peter J Bertheaud

(74) *Attorney, Agent, or Firm* — Jansson Munger McKinley & Kirby Ltd.

(57) ABSTRACT

An improved system, apparatus and method for injecting a chemical from a storage tank into a natural gas or liquefied petroleum gas pipeline at a flow-controlled injection rate is provided. The system, apparatus and method including a pair of positive-displacement pumps driven in substantially complementary fashion by a single driver, a controller controlling the driver, and each pump being fed from the storage tank and discharging chemical into the pipeline. The system, apparatus and method may also include a second pair of positive-displacement pumps having substantially similar displacement and operatively connected to the first pair of positive-displacement pumps, the first pair of positive-displacement pumps being driven in a substantially complementary fashion with the second pair of pumps by a single driver or a pair of drivers.

7 Claims, 5 Drawing Sheets

(51) Int. Cl.
*F04B 13/00* (2006.01)
*F04B 23/06* (2006.01)

(56) References Cited

U.S. PATENT DOCUMENTS

| | | | | | |
|---|---|---|---|---|---|
| 2,871,789 | A * | 2/1959 | Kiffer | F04B 13/02 | 417/383 |
| 2,946,488 | A * | 7/1960 | Kraft | B01F 15/0475 | 222/134 |
| 3,134,508 | A * | 5/1964 | Bayer | F04B 7/0015 | 222/129.4 |
| 3,216,434 | A | 11/1965 | Lovendahl | | |
| 3,257,952 | A * | 6/1966 | McCormick | F04B 43/107 | 417/383 |
| 3,304,870 | A * | 2/1967 | Growall | F04B 43/026 | 417/388 |
| 3,338,170 | A * | 8/1967 | Swartz | F04B 43/107 | 333/22 R |
| 3,471,079 | A | 10/1969 | Myers | | |
| 3,796,516 | A * | 3/1974 | McCormick | F04B 43/107 | 417/388 |
| 3,917,531 | A * | 11/1975 | Magnussen | B01D 15/163 | 210/101 |
| 4,540,346 | A * | 9/1985 | Davies | F04B 43/067 | 417/273 |
| 4,775,481 | A * | 10/1988 | Allington | G01N 30/32 | 210/101 |
| 5,141,412 | A | 8/1992 | Meinz | | |
| 5,406,970 | A | 4/1995 | Marshall et al. | | |
| 5,490,766 | A | 2/1996 | Zeck | | |
| 6,142,162 | A | 11/2000 | Arnold | | |
| 6,162,030 | A | 12/2000 | Pierrat | | |
| 6,208,913 | B1 | 3/2001 | Marshall et al. | | |
| 8,349,038 | B2 | 1/2013 | Zeck | | |
| 9,261,087 | B2 * | 2/2016 | Kristola | F04B 9/042 | |
| 2001/0014840 | A1 | 8/2001 | Marshall et al. | | |
| 2001/0047621 | A1 | 12/2001 | Arnold | | |
| 2009/0242035 | A1 | 10/2009 | Zeck | | |
| 2012/0167465 | A1 | 7/2012 | Zeck | | |

* cited by examiner

DETAIL D

CHEMICAL INJECTION SYSTEM

CROSS-REFERENCE TO RELATED APPLICATION

This application is a continuation of U.S. patent application Ser. No. 13/598,208, filed Aug. 29, 2012, which will issue on Feb. 16, 2016 as U.S. Pat. No. 9,261,087, the contents of which are incorporated by reference in its entirety.

FIELD OF THE INVENTION

The present invention relates generally to systems for injecting chemicals into pipelines and, more specifically, to an improved system for adding odorant to natural gas or liquified petroleum gas flowing in a pipeline.

BACKGROUND OF THE INVENTION

There are many instances in which it is desirable to inject chemicals of various types into fluids (gas and liquids) flowing in pipelines. One such example is in the area of natural gas pipelines. In addition to such substances as corrosion inhibitors and alcohol to inhibit freezing, odorants are commonly injected into natural gas pipelines. Natural gas is odorless. Odorant is injected into natural gas in order to provide a warning smell for consumers. Commonly used odorants include tertiary butyl mercaptan (TBM). Such odorants are typically injected in relatively small volumes normally ranging from about 0.5 to 1.0 lbs/mmscf.

The odorants are typically provided in liquid form and are typically added to the gas at a location where distribution gas is taken from a main gas pipeline and provided to a distribution pipeline. In such circumstances, the gas pressure may be stepped down through a regulator from, for example, 600 psi or more, to a lower pressure in the range of 100 psi or less. The odorants can also be added to the main transmission pipeline in some situations.

As can be seen above, the odorants which are added to natural gas are extremely concentrated. Odorants such as TBM and other blends are mildly corrosive and are also very noxious. If the job of injecting odorant is not performed accurately, lives are sometimes endangered. It would be possible for a homeowner to have a gas leak without it being realized until an explosion had resulted if the proper amount of odorant was not present. Also, if a leak of odorant occurs at an injection site, people in the surrounding area will assume that a gas leak has occurred with areas being evacuated and commerce being interrupted. Contrarily, if such mistakes become common, people in the surrounding area will become desensitized to the smell of a potential gas leak and will fail to report legitimate leaks.

Two techniques are commonly used for providing odorization to natural gas in a main distribution pipeline. One technique involves bypassing a small amount of natural gas at a slightly higher pressure than the pressure of the main distribution pipeline, through a tank containing liquid odorant. This bypass gas absorbs relatively high concentrations of odorant while it is in the tank. This heavily odorized bypass gas is then placed back into the main pipeline. The odorant, now volatilized, is placed back into the main pipeline and diffuses throughout the pipeline. However, there are a number of disadvantages associated with the bypass system for odorizing pipelines. One disadvantage of the bypass system is the fact that the bypass gas picks up large and inconsistent amounts of odorant from the liquid in the tank and becomes completely saturated with odorant gas. As a result, it is necessary to carefully monitor the small amounts of bypass gas which are used. Also, natural gas streams typically have contaminates such as compressor oils or condensates which can fall out into the odorant vessel in bypass systems. These contaminates create a layer that reduces the contact area between the liquid and the bypass stream. This necessarily degrades the absorption rate of the stream failing to accurately measure and control the amount of odorant being added to the stream. This absorption amount can change as condensates and other contaminates fall out and change the absorption boundary layer.

Another technique involves the injection of liquid odorant directly into the pipeline through the use of a high-pressure injection pump. High-volume odorizers have depended on a traditional positive-displacement pump or solenoid valve to deliver discrete doses of odorant to natural gas or liquid propane gas (LPG) streams for the purpose of bringing these streams to safe perception levels. However, injecting discrete doses in this manner results in higher pressure drops due to the higher piston speed. The higher the piston speed, the more likely the odorant will vaporize and the more likely entrainment of gas. Such vapor lock is detrimental to the performance and accuracy of odorant injection systems. These methods can leave dangerous dead time between doses. Because odorant is extremely volatile, drops injected to the pipeline immediately disperse and spread throughout the gas in the pipeline. In this way, within a few seconds, the drops of liquid odorant are dispersed in gaseous form.

There are also several disadvantages with this prior art technique. As mentioned above, the odorant liquid is extremely noxious. The injection pump must therefore be designed so that no odorant can leak. This requires a pump design which is relatively expensive and complex in order to meet the required operating conditions. Even in such sophisticated systems, there is an unpleasant odor present when working on the pump which can make people think that there is a natural gas leak. There continues to be a need for improvements in odorization systems of the above described types.

The present invention relates to an improved system, apparatus and method for injecting chemical into a pipeline which prevents escape of odorant, nearly eliminates dead time between doses, and provides a reliable, uniform injection rate over a wide variety of rate requirements.

OBJECTS OF THE INVENTION

It is an object of the present invention to provide an improved chemical injection system for metering odorant into pipelines overcoming some of the problems and shortcomings of the prior art, including those referred to above.

Another object of the invention is to provide a chemical injection system which allows precise metering of a chemical injected into a pipeline.

Another object of the invention is to provide a chemical injection system which provides continuous flow of odorant.

Another object of the invention is to provide a chemical injection system which allows a wide range of chemical dosing.

Another object of the invention is to provide a self-priming chemical injection system which is low-maintenance.

Another object of the invention is to provide a chemical injection system which allows maintenance of the power unit without exposure to the chemical.

Another object of the invention is to provide a chemical injection system which prevents flashing of odorant and vapor lock.

Still another object of the invention is to allow use of low pressure blanket gas which inhibits gas entrainment.

How these and other objects are accomplished will become apparent from the following descriptions and drawing figures.

SUMMARY OF THE INVENTION

The instant invention overcomes the above-noted problems and satisfies the objects of the invention. A system, apparatus and method for injecting a chemical from a storage tank into a natural gas or LPG pipeline at a flow-controlled injection rate is provided. The chemical injection system, apparatus and method includes a pair of positive-displacement pumps, the pair having a first positive-displacement pump and a second positive-displacement pump, each having substantially similar displacement and driven in complementary fashion by a driver. The chemical injection system, apparatus and method also includes a controller for controlling the driver, with each pump being fed from the storage tank and injecting chemical into the pipeline.

Accordingly, a preferred embodiment of the present invention provides a chemical injection system, apparatus and method which utilizes a positive-displacement pump to pump odorant from a liquid storage tank into a small pipe which empties directly into the main gas pipeline. The pump is operated by a power unit or motor which is responsive to a controller which, in turn, calculates the necessary amount of chemical to be dosed based on the flow rate of the natural gas or LPG in a pipeline. A flow-rate meter is connected to the pipeline and provides a signal to the controller. As the flow rate within the pipeline fluctuates, the controller will increase or decrease the speed of the power unit, which in turn increases or decreases the speed of the positive-displacement pumps and, consequently, the rate of chemical injection into the pipeline. A second flow-rate meter may be provided in the pump discharge line which measures the rate of chemical being pumped and generates a signal to the controller. The controller then compares the pipeline flow rate to the pump discharge flow rate to assure that the proper amount of chemical is being injected into the pipeline. In the event that the controller determines that the flow rate of the chemical being discharged from the pumps is deficient or excessive with respect to the desired rate, the controller will adjust the speed of the power unit accordingly to correspond with the pipeline gas flow rate requirement.

Another preferred embodiment of the present invention provides a chemical injection system, apparatus and method which includes a second pair of positive-displacement pumps having substantially similar displacement and operatively connected to the first pair of positive-displacement pumps. The first pair of positive-displacement pumps are driven in a substantially complementary fashion with the second pair of pumps by the driver. A controller is provided which controls the driver, with each pump being fed from the storage tank and discharging chemical into the pipeline. An additional preferred embodiment may include pumps which are substantially similar bellows-type pumps. Another preferred embodiment may include a pair of substantially similar hydraulic actuators, one of each hydraulic actuator being operatively connected to one of each first pump and second pump of the pair of positive-displacement pumps and driven by the driver.

Another preferred embodiment of the present invention provides a chemical injection system, apparatus and method which includes a first and second pair of positive-displacement pumps being driven in a substantially complementary fashion with a first and a second driver. Another preferred embodiment may include a first and a second pair of substantially similar hydraulic actuators, the first pair of hydraulic actuators being operatively connected to the first pair of pumps and driven by the first driver, and the second pair of hydraulic actuators being operatively connected to the second pair of positive-displacement pumps and driven by the second driver.

In yet other preferred embodiments, the driver may include a rotary motor and a rotary-to-linear transmission driving the pistons of the hydraulic actuators in complementary linear fashion. The driver may be an electric motor. The transmission may preferably include a scotch yoke.

BRIEF DESCRIPTION OF THE DRAWING FIGURES

In order that the advantages of the invention will be readily understood, a more detailed description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF PREFERRED EMBODIMENTS

The present invention utilizes a positive-displacement pump. An advantage of using a positive-displacement pump is that the pressure of the blanket gas in the chemical supply tank can be lower than that associated with the use of a centrifugal pump. Limiting how much gas is dissolved in the odorant inhibits vaporization, vapor lock, and gas entrainment. Another key advantage is that a positive-displacement pump system can be designed to provide exacting accuracy of a chemical at slower speeds, thereby minimizing maintenance of the system. The preferred embodiment of the present invention includes the use of a bellows-type positive-displacement pump. Bellows-type pumps offer key advantages such as a design which reduces system stress and provides an infinite life versus other types of positive-displacement pumps commonly used in chemical systems such as a diaphragm pump. Despite shortcomings of other positive-displacement pumps, any such type may nonetheless be substituted.

Figure 1:
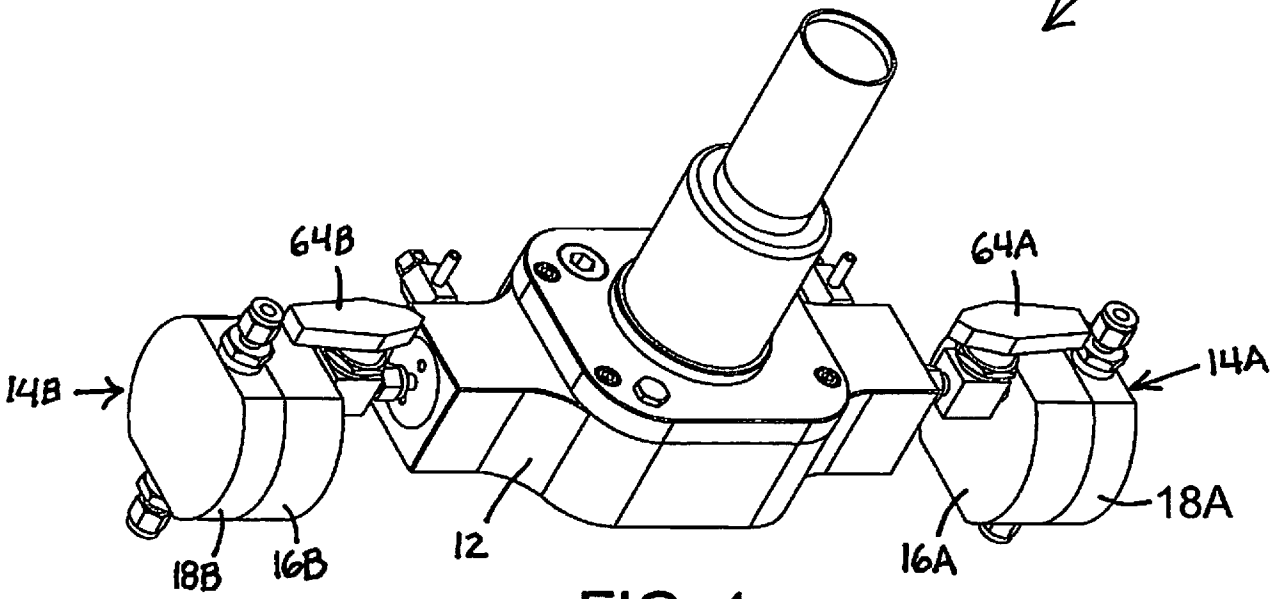
FIG. 1 is a perspective view of the preferred positive-displacement pump assembly for use in the chemical injection system according to an exemplary embodiment of the present invention.
Figure 2:
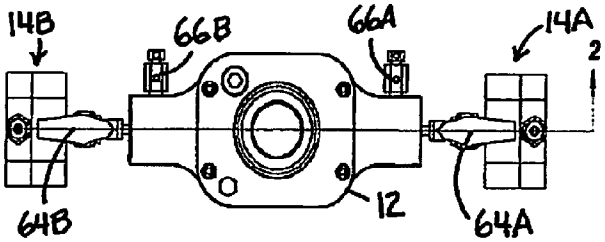
FIG. 2 is a top view of the preferred embodiment illustrated in FIG. 1.
Figure 4:
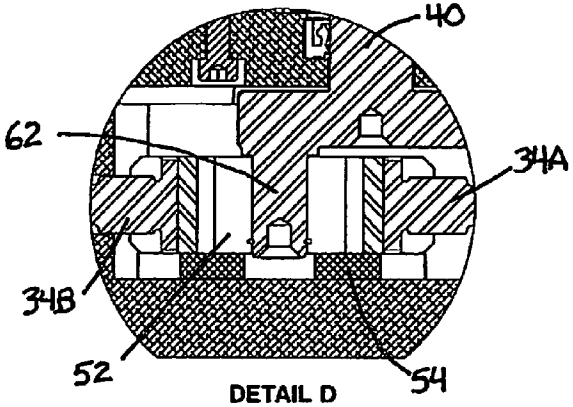
FIG. 4 is an enlarged view of section D of FIG. 3 which shows the rotary-to-linear mechanism used in the preferred embodiment of the present invention.
Figure 3:
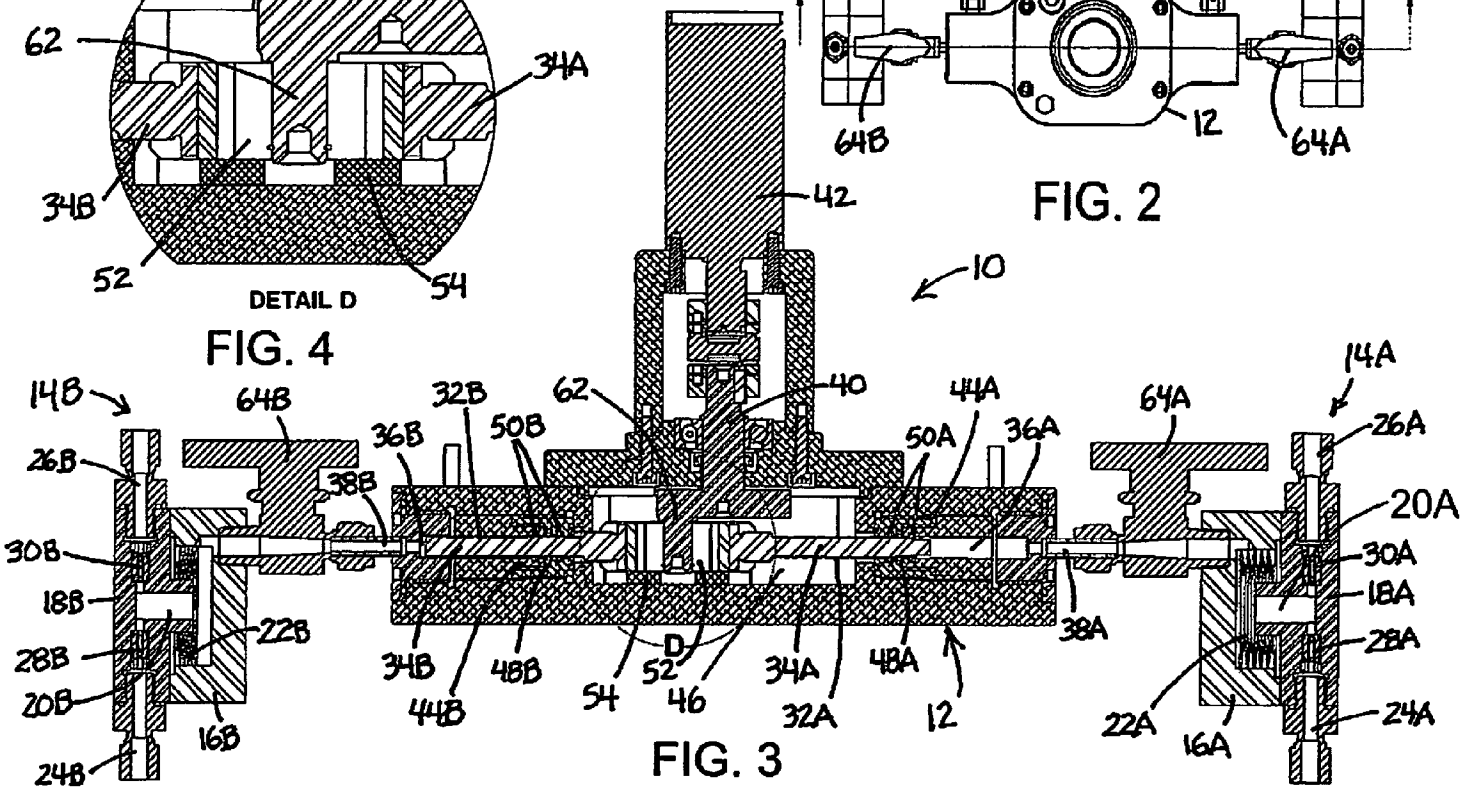
FIG. 3 is a cross-sectional view along lines 2-2 of FIG. 2 which shows one of the hydraulic actuators of the positive-displacement pump in a fully-extended position and the other hydraulic actuator in a fully-retracted position of the preferred embodiment.

As shown in FIGS. 1-3, bellows-type positive-displacement pump assembly 10 includes an actuator housing 12 and two opposed bellows pumps 14A, 14B. Pumps 14A, 14B each have a proximal portion 16A, 16B and a distal portion 18A, 18B. Proximal portions 16A, 16B each include a hydraulic chamber 20A, 20B and a bellows odorant capsule 22A, 22B. Distal portions 18A, 18B each include a chemical supply inlet line 24A, 24B and a chemical discharge line 26A, 26B. Supply springless check valves 28A, 28B are provided in the chemical supply inlet line 24A, 24B and discharge springless check valves 30A, 30B are provided in pump discharge line 26A, 26B. Ceramic springless check valves are preferred because of their superior ball and seat sealing properties, fast response and resistance to buildup.

As seen in FIG. 3, actuator housing 12 houses two actuators 32A, 32B. Each actuator includes a piston 34A, 34B, a hydraulic chamber 36A, 36B, and a discharge line 38A, 38B. Actuator discharge lines 38A, 38B are in fluid communication with bellows hydraulic chambers 20A, 20B. A yoke 40 is coupled to gear box 42 which is operatively connected to actuators 32A, 32B. While a scotch yoke is preferred due to its simplicity, low maintenance and low cost, other drive mechanisms can be used.

Seal housings 44A, 44B seal actuators 32A, 32B from yoke box 46 by use of a glide ring seals 48A, 48B. Also provided in actuator seal housings are glide rings 50A, 50B which assist in maintaining axial alignment of the actuators. Yoke 40 includes cam bearing 52 which is operatively attached to pistons 34A, 34B. A linear guide 54 is also provided in yoke box 46 which is in contact with cam bearing 52 and pistons 34A, 34B to maintain axial alignment of the actuators during operation.

Figure 5:
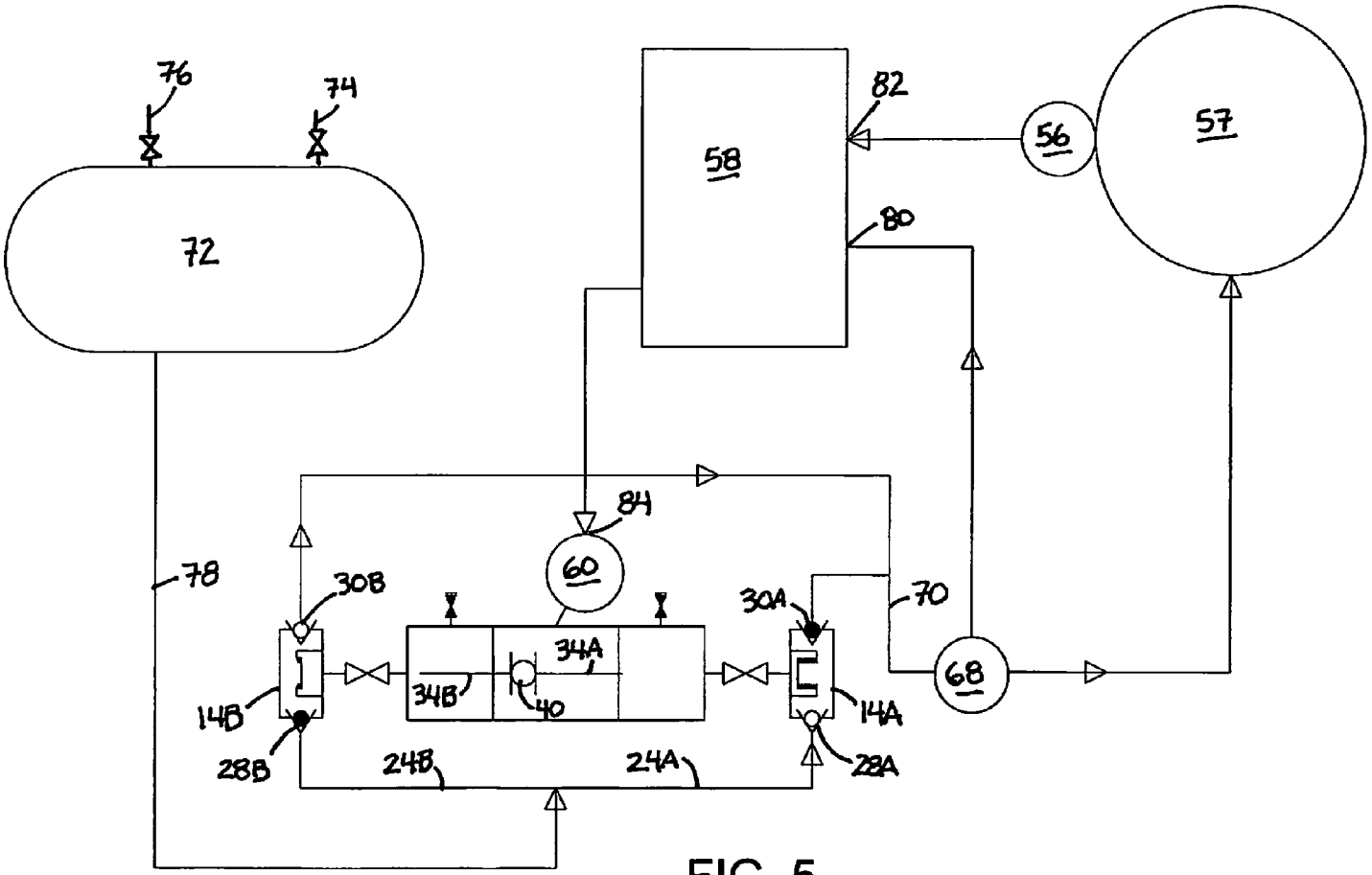
FIG. 5 is a schematic view of the preferred embodiment of the chemical injection system of the present invention.

In operation, as shown in FIG. 5, a pipeline flow-rate meter 56 located on pipeline 57 sends a signal to controller 58 which calculates the rate of chemical injection needed and sends a signal to the power unit 60 to either increase speed or decrease speed accordingly. Power unit 60 motivates gear box 42 (see FIG. 3) which in turn operates yoke 40 at the appropriate speed. Yoke 40 transmits the rotary action of the power unit to linear movement to drive actuator pistons 34A, 34B in a synchronized fashion. In other words, one piston is in compression and the other is in retraction. The net result is that the system sees continuous metered flow of odorant to the pipeline and softens out the sinusoidal nature of a positive-displacement pump.

As best seen in FIG. 3, yoke cam 62 positively engages actuator pistons 34A, 34B, which extends actuator piston 34B into actuator hydraulic chamber 36B forcing hydraulic fluid through the actuator discharge line 38B and into the hydraulic chamber 20B of bellows pump 14B. This displaced hydraulic fluid from the actuator hydraulic chamber into the bellows hydraulic chamber causes compression of bellows 14B which consequently displaces the equivalent volume of odorant through discharge springless check valve 30B within bellows pump 14B into the pump discharge line 26B and into the pipeline 57. Simultaneously, while yoke cam 42 is extending actuator piston 34B into its hydraulic chamber, yoke cam 62 is also retracting actuator piston 34A causing a low pressure in bellows pump odorant capsule 22A thereby opening supply springless check valve 28A of bellows pump 14A and filling odorant capsule 22A. The volume of chemical entering odorant capsule 22A is equal to the volume of hydraulic fluid in hydraulic chamber 36A of actuator 32A. Conversely, as yoke 40 continues its rotation, yoke cam 62 extends actuator piston 34A into its hydraulic chamber 36A and into bellows hydraulic chamber 20A, compressing bellows odorant capsule 22A, thereby raising the pressure within bellows hydraulic chamber 20A. Such higher pressure forces supply springless check valve 28A closed and opens discharge springless check valve 30A, discharging an equivalent volume of chemical through the discharge line and into pipeline 57.

The volume of displacement of each of the actuators is substantially equal. It will be understood that the larger the displacement of the actuators, the slower the speed of the power unit may be. As piston speeds increase, pressure drops increase. By keeping piston speeds slow, pressure drops in the pump are minimized, and "flashing" or vaporization of the fluids is prevented. Flashing or vaporization may be a cause of vapor lock and gas entrainment which are both detrimental to performance and accuracy of odorant injection systems.

As seen in FIGS. 1-3, bellows pumps 14A, 14B are isolated from actuator housing 12 by isolation valves 64A, 64B. Isolation valves 64A, 64B are provided to allow safe maintenance of the actuators and power unit by eliminating contact with the chemical. In addition, isolation between the actuators and pumps provides the ability to perform maintenance without disturbing the bellows pumps which minimizes re-priming efforts at start up. As best seen in FIG. 2, hydraulic actuator housing 12 includes bleed valves 66A, 66B for bleeding hydraulic pressure prior to removal from the bellows pumps.

A second flow-rate meter 68 may be utilized in the pump discharge line 70. Second flow-rate meter 68 measures the pump discharge rate and sends a signal to controller 58. Controller 58 compares the flow rate of pipeline 57 to the flow rate of the pump discharge line 70 and regulates the speed of power unit 60. If the actual pump discharge flow rate does not match the desired flow rate as calculated from the flow-rate sensor 56 of pipeline 57, controller 58 adjusts the power unit 60 accordingly. The faster power unit 60 turns, the faster actuator pistons 34A, 34B displace hydraulic fluid into bellows hydraulic chambers 20A, 20B, and the faster odorant is discharged from bellows odorant capsules 22A, 22B. Although many types of flow-rate meters exist, positive-displacement flow-rate meters are preferred due to their cost versus performance benefit.

FIG. 5 shows a schematic of a preferred embodiment of the present invention. FIG. 5 shows a chemical supply tank 72, having chemical inlet 74, blanket gas inlet 76, and discharge conduit 78. Supply tank discharge conduit 78 supplies chemical to bellows pumps 14A, 14B through their respective chemical supply inlet lines 24A, 24B, supply springless check valves 28A, 28B and into bellows odorant capsules 22A, 22B. Bellows odorant capsules 22A, 22B are discharged through discharge springless check valves 30A, 30B into pipeline 57. Natural gas or LPG flows from pipeline 57 through pipeline flow-rate meter 56 generating a control signal which is passed to controller 58. Controller 58 calculates the rate of chemical injection needed and sends a signal to power unit or motor 60. Power unit 60, through yoke 40, reciprocally moves actuator pistons 34A, 34B, which displace hydraulic fluid into bellows hydraulic chambers 20A, 20B which reciprocally compress bellows odorant capsules 22A, 22B, thereby injecting chemical into pipeline 57 through pump discharge line 70.

Second flow-rate meter 68 can be located in pump discharge line 70 to measure the pump discharge flow-rate and provide a signal to controller 58 at 80. Controller 58 compares the signal generated by the pump discharge flow-rate meter 80 to the signal generated by the pipeline flow-rate meter 56 at 82. Upon comparison of the signals generated at 80 and 82, the controller 58 generates an adjustment signal 84 which adjusts power unit 60 so that the actual flow of chemical matches the desired flow of chemical injected into the pipeline.

Figure 6:
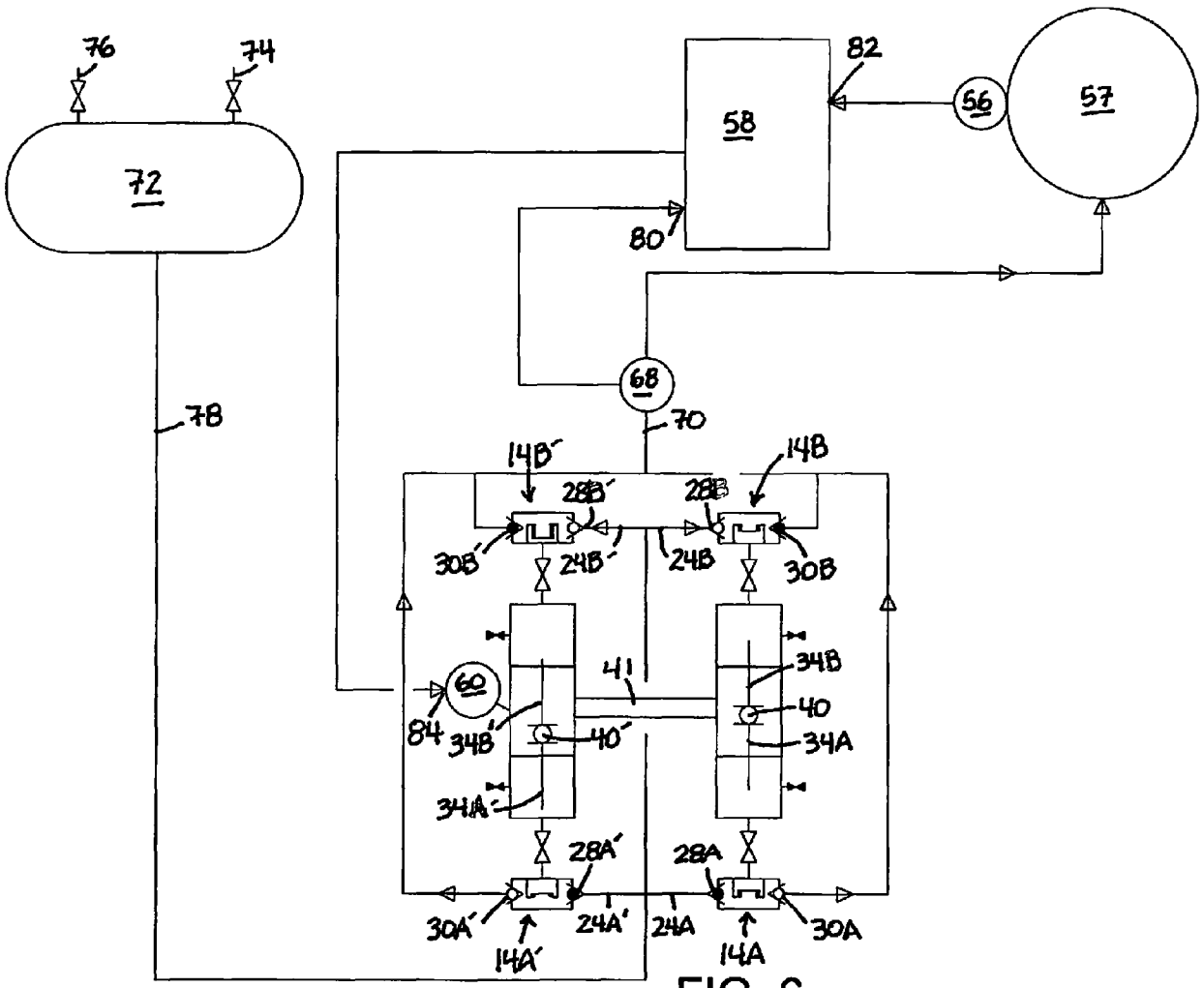
FIG. 6 is a schematic view of another embodiment of the chemical injection system of the present invention.

FIG. 6 shows a schematic of another preferred embodiment of the present invention. FIG. 6 shows a chemical supply tank 72, having chemical inlet 74, blanket gas inlet 76, and discharge conduit 78. Supply tank discharge conduit 78 supplies chemical to bellows pumps 14A, 14A' and 14B, 14B' through their respective chemical supply inlet lines 24A, 24A' and 24B, 24B' supply springless check valves 28A, 28A' and 28B, 28B' and into bellows odorant capsules 22A, 22A' and 22B, 22B'. Bellows odorant capsules 22A, 22A' and 22B, 22B' are discharged through discharge springless check valves 30A, 30A' and 30B, 30B' into pipeline 57. Natural gas or LPG flows from pipeline 57 through pipeline flow-rate meter 56 generating a control signal which is passed to controller 58. Controller 58 calculates the rate of chemical injection needed and sends a signal to power unit or motor 60. Power unit 60, through yokes 40, 40' and corresponding linkage 41, reciprocally moves actuator pistons 34A, 34A' and 34B, 34B' which displace hydraulic fluid into bellows hydraulic chambers 20A, 20A' and 20B, 20B', which reciprocally compress bellows odorant capsules 22A, 22A' and 22B, 22B' thereby injecting chemical into pipeline 57 through pump discharge line 70.

Second flow-rate meter 68 can be located in pump discharge line 70 to measure the pump discharge flow-rate and provide a signal to controller 58 at 80. Controller 58 compares the signal generated by the pump discharge flow-rate meter 80 to the signal generated by the pipeline flow-rate meter 56 at 82. Upon comparison of the signals generated at 80 and 82, the controller 58 generates an adjustment signal 84 which adjusts power unit 60 so that the actual flow of chemical matches the desired flow of chemical injected into the pipeline.

Figure 7:
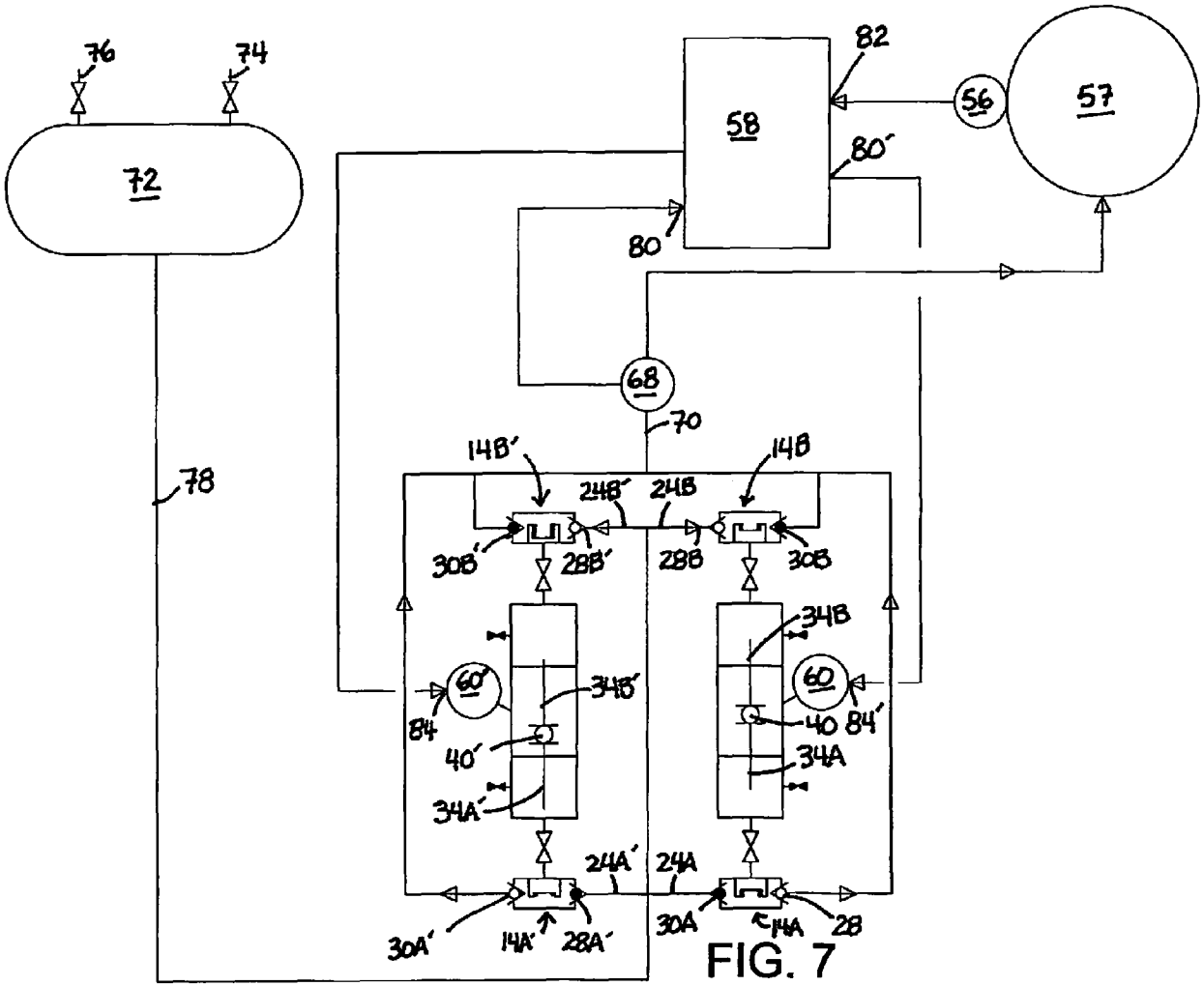
FIG. 7 is a schematic view of yet another embodiment of the chemical injection system of the present invention.

FIG. 7 shows a schematic of yet another preferred embodiment of the present invention. FIG. 7 shows a chemical supply tank 72, having chemical inlet 74, blanket gas inlet 76, and discharge conduit 78. Supply tank discharge conduit 78 supplies chemical to bellows pumps 14A, 14A' and 14B, 14B' through their respective chemical supply inlet lines 24A, 24A' and 24B, 24B', supply springless check valves 28A, 28A' and 28B, 28B' and into bellows odorant capsules 22A, 22A' and 22B, 22B'. Bellows odorant capsules 22A, 22A' and 22B, 22B' are discharged through discharge springless check valves 30A, 30A' and 30B, 30B' into pipeline 57. Natural gas or LPG flows from pipeline 57 through pipeline flow-rate meter 56 generating a control signal which is passed to controller 58. Controller 58 calculates the rate of chemical injection needed and sends a signal to first power unit 60 and second power unit 60'. Power units 60, 60' through yokes 40, 40' reciprocally move actuator pistons 34A, 34A' and 34B, 34B' which displace hydraulic fluid into bellows hydraulic chambers 20A, 20A' and 20B, 20B' which reciprocally compress bellows odorant capsules 22A, 22A' and 22B, 22B', thereby injecting chemical into pipeline 57 through pump discharge line 70.

Second flow-rate meter 68 can be located in pump discharge line 70 to measure the pump discharge flow-rate and provide a signal to controller 58 at 80, 80'. Controller 58 compares the signal generated by the pump discharge flow-rate meter 80, 80' to the signal generated by the pipeline flow-rate meter 56 at 82. Upon comparison of the signals generated at 80, 80' and 82, the controller 58 generates an adjustment signal 84 which adjusts power units 60, 60' so that the actual flow of chemical matches the desired flow of chemical injected into the pipeline.

Reference throughout this specification to "the embodiment," "this embodiment," "the previous embodiment," "one embodiment," "an embodiment," "a preferred embodiment" "another preferred embodiment" or similar language means that a particular feature, structure, or characteristic described in connection with the embodiment is included in at least one embodiment of the present invention. Thus, appearances of the phrases "in the embodiment," "in this embodiment," "in the previous embodiment," "in one embodiment," "in an embodiment," "in a preferred embodiment," "in another preferred embodiment," and similar language throughout this specification may, but do not necessarily, all refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

While the present invention has been described in connection with certain exemplary or specific embodiments, it is to be understood that the invention is not limited to the disclosed embodiments, but, on the contrary, is intended to cover various modifications, alternatives and equivalent arrangements as will be apparent to those skilled in the art. Any such changes, modifications, alternatives, modifications, equivalents and the like may be made without departing from the spirit and scope of the invention.

The invention claimed is:

1. An apparatus for injecting a chemical from a storage tank into a natural gas or liquefied petroleum gas pipeline at a flow-controlled injection rate, the improvement comprising;

at least one positive-displacement pump fed from the storage tank and discharging chemical through a pump discharge line into the pipeline;

a controller controlling the at least one pump;

a first flow-rate sensor for sensing the flow-rate of natural gas or liquefied petroleum gas in the pipeline, the first flow-rate sensor generating a control signal to the controller to calculate and set a desired chemical injection rate; and a second flow-rate sensor for sensing a chemical discharge flow-rate in the pump discharge line, the second flow-rate sensor generating a control signal to the controller to compare the chemical discharge flow-rate with the desired chemical injection rate and adjust the chemical discharge flow-rate accordingly.

2. The apparatus of claim 1 wherein the at least one pump is a bellows-type pump.

3. The apparatus of claim 1 wherein the at least one pump is driven by a rotary electric motor.

4. The apparatus of claim 3 further including a rotary-to-linear transmission.

5. The apparatus of claim 1 wherein the at least one positive displacement pump comprises two or more pumps.

6. The apparatus of claim 5 wherein each pump has an associated isolation valve.

7. A method for injecting a chemical from a storage tank into a natural gas or liquefied petroleum gas pipeline at a flow-controlled injection rate, comprising:

measuring the rate of natural gas or liquefied petroleum gas moving through the pipeline by use of a first flow-rate sensor which generates a control signal to a controller;

automatically calculating and setting a desired chemical injection rate by regulating the speed of a motor in response to the control signal;

injecting the chemical into the pipeline through a discharge line of at least one positive-displacement pump at a rate responsive to the control signal; and measuring an actual chemical injection rate by a second flow-rate sensor which generates a control signal to the controller; and automatically comparing the actual chemical injection rate with the desired chemical injection rate and adjusting the speed of the motor to maintain the desired chemical injection rate.

* * * * *